US008210647B2

(12) United States Patent
Shimazu et al.

(10) Patent No.: US 8,210,647 B2
(45) Date of Patent: Jul. 3, 2012

(54) INKJET PRINTING HEAD

(75) Inventors: Satoshi Shimazu, Kawasaki (JP); Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 412 days.

(21) Appl. No.: 12/484,486

(22) Filed: Jun. 15, 2009

(65) Prior Publication Data

US 2009/0309927 A1 Dec. 17, 2009

(30) Foreign Application Priority Data

Jun. 17, 2008 (JP) ..... 2008-158206
May 29, 2009 (JP) ..... 2009-130835

(51) Int. Cl.
*B41J 2/135* (2006.01)

(52) U.S. Cl. ..... 347/44

(58) Field of Classification Search ..... None
See application file for complete search history.

(56) References Cited

U.S. PATENT DOCUMENTS

| | | | | |
|---|---|---|---|---|
| 5,808,641 | A * | 9/1998 | Miyagawa et al. | 347/65 |
| 5,933,163 | A | 8/1999 | Koizumi et al. | |
| 7,547,094 | B2 * | 6/2009 | Kawamura et al. | 347/50 |
| 7,712,870 | B2 | 5/2010 | Shibata et al. | |
| 2007/0006459 | A1 | 1/2007 | Ono et al. | |
| 2007/0285465 | A1 * | 12/2007 | Shibata et al. | 347/47 |
| 2009/0002453 | A1 | 1/2009 | Ono | |
| 2009/0309923 | A1 | 12/2009 | Saikawa et al. | |
| 2009/0309926 | A1 | 12/2009 | Toda et al. | |

FOREIGN PATENT DOCUMENTS

| | | |
|---|---|---|
| CN | 101073944 A | 11/2007 |
| JP | 10-44420 | 2/1998 |
| JP | 2002-019119 | 1/2002 |

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

To form an inkjet printing head which is not deteriorated in printing quality or broken in production processes, a rib capable of being displaced upon receiving an influence of stress resulting from a sealant is installed at a position opposing the long side face of a printing element substrate, and the sealant is used to seal between the ribs and the printing element substrate.

12 Claims, 11 Drawing Sheets

INKJET PRINTING HEAD

BACKGROUND OF THE INVENTION

1. Field of the Invention

The present invention relates to an inkjet printing head used in a printing apparatus for ejecting printing solutions such as inks from ejection ports to print.

2. Description of the Related Art

In recent years, machines such as computers, facsimile machines and copiers have spread widely. And, various printing methods have been developed and used in these machines. Among other things, an inkjet printing apparatus adopting an inkjet printing method in which inks are ejected on a printing medium for printing has excellent characteristics, that is, it is easier in providing high-accuracy printing than those according to other printing methods, capable of printing at high speed quietly and also lower in price.

The above-described inkjet printing apparatus is provided with a printing head having ejection ports for ejecting inks. Then, known methods for ejecting inks include a method in which an electromechanical converter such as a piezoelectric element is used to eject inks and a method in which an electrothermal converter such as a heating resistor is installed to heat inks, thereby causing film boiling to eject inks due to the action thereof.

FIG. 8 is a view showing a conventional inkjet printing cartridge (hereinafter, simply referred to as a printing cartridge as well). A printing cartridge 601 is constituted by forming an inkjet printing head unit containing a printing element substrate 702 made with silicon or the like integrally with an ink container unit 709 containing inks there inside. The printing element substrate 702 is provided with a heater for ejecting inks by converting electric energy to thermal energy. The printing element substrate 702 is constituted with a substrate having a wiring for transmitting the electric energy supplied from an inkjet printing apparatus to the heater, channels for supplying inks to the heater and a nozzle plate having a plurality of ejection ports for ejecting inks. Then, one printing element substrate 702 is provided with ejection port rows 703, 704, 705 for ejecting three color inks, that is, yellow, magenta, and cyan. An electric wiring substrate 706 is to transmit an electric signal from the inkjet printing apparatus to the printing element substrate 702, transmitting the electric signal from the inkjet printing apparatus via an external signal input terminal 707. The electric wiring substrate 706 is electrically connected to the printing element substrate 702 at two end faces of the printing element substrate 702, and the electrically connected part is covered with a sealant 708 and protected from the inks.

FIG. 9 is a drawing showing a supporting substrate 802 for supporting the printing element substrate 702 and a supporting plate 804 for fixing and supporting the electric wiring substrate 706. The supporting substrate 802 is made with a material such as alumina for bonding and fixing the printing element substrate 702 with high accuracy and also subjected to polishing. The supporting plate 804 is also made with a material such as alumina, as in the case of the supporting substrate 802.

FIG. 10 is a cross-sectional view taken along the line X to X in FIG. 8. The supporting substrate 802 is provided with ink supply ports 803 for supplying inks inside the ink container unit 709 to the printing element substrate 702, and the printing element substrate 702 is installed so that the above-described ink supply ports 803 are communicatively connected to the ink supply ports 803 of the printing element substrate 702. Further, a supporting plate 804 is installed so as to enclose the periphery of the printing element substrate 702. A sealant 805 is placed between the printing element substrate 702 and the supporting plate 804 to seal them, thereby preventing inks from entering between the printing element substrate 702 and supporting plate 804. If no sealant 805 is used for this purpose, an ink will enter between the printing element substrate 702 and the supporting plate 804 and the ink will adhere on a side face end of the printing element substrate 702. Silicon is exposed at the side face end of the printing element substrate 702, and there is a case where the silicon will leak out when the ink adheres on the side face end thereof.

The sealant 805 is used to seal between the printing element substrate 702 and the supporting plate 804, thus making it possible to prevent leakage of silicon. Further, it is because an electrically connected part is protected from an ink that the sealant 805 is used to seal between the printing element substrate 702 and the supporting plate 804. As the sealant 805, there is generally used a thermosetting resin which can be handled relatively easily in production processes.

The accuracy on installation of the printing element substrate 702 directly influences the printing accuracy of an inkjet printing apparatus. Thus, in order to increase the accuracy on installation thereof or increase a yield in production processes, various proposals have been so far made. Japanese Patent Laid-Open No. H10-044420 (1998) has proposed that in fixing a printing element substrate, a supporting substrate substantially equal in thermal characteristics to the printing element substrate be bonded to fix the printing element substrate. Further, Japanese Patent Laid-Open No. 2002-019119 has proposed that a supporting substrate such as alumina be bonded between a printing element substrate and a supporting member, thereby preventing the breakage of the printing element substrate due to a difference in the coefficient of linear expansion.

In recent years, in order to reduce the cost of a printing element substrate which is the most expensive among production costs of an inkjet printing head (hereinafter, simply referred to as a printing head as well), there have been many requests that the printing element substrate be downsized to increase the number of printing element substrates per silicon wafer. It has been considered that ejection port rows be arranged in narrower intervals as a means of downsizing the printing element substrate. However, arrangement of the ejection port rows in narrower intervals will always entail a thinner wall part on the periphery of an ejection port, thus resulting in a less stiff part on the printing element substrate. As described above, since the periphery of the printing element substrate is sealed by a thermosetting-type sealant, shrinkage on curing will generate stress inside the sealant, and the stress acts so as to draw the printing element substrate outwardly.

FIG. 11 is an enlarged view of a peripheral part of the sealant 805 in the cross sectional view of FIG. 10, and shows how the stress inside the sealant 805 acts on the printing element substrate 702. In production of the printing head, in order to cure an adhesive agent and the sealant for fixing the printing element substrate 702, the supporting plate 804 and the supporting substrate 802, these are placed into an oven kept at 100° C. In this case, these members undergo thermal expansion and are cured in an expanded state. A coefficient of expansion at this time is different depending on the material of each of the members. When the printing head is taken out from the oven after the adhesive agent and the sealant are cured, these members will return to their original state from an expanded state due to the fact that the temperature is lowered to a room temperature. Further, a generally-used thermosetting-type sealant is known to undergo approximately 5% shrinkage on curing. Therefore, as shown in FIG. 11, due to the shrinkage on curing and change in temperature of these members, stress is generated inside the sealant 805 in a direction indicated by the arrow in the figure. Although not shown in the figure, which only covers a part of the inkjet printing head, a similar state is found on the side face opposite to the printing element substrate 702. More specifically, there is a force working on the printing element substrate 702 from the side face to the outside.

As described above, where there is found stress on the printing element substrate 702, as apparent from FIG. 10, the sides of an opening part of the printing element substrate 702 in contact with the sealant 805 are small in cross-sectional area and, therefore, may be easily deformed where the force is applied thereto. Further, the printing element substrate 702 is different in opening area composed of ejection ports, ink supply ports and others between the face in contact with the supporting substrate 802 and the face opposing thereto. Therefore, the printing element substrate 702 may be bent backwardly and deformed, if the force is applied thereto by the sealant 805. Where the printing head of the thus deformed printing element substrate 702 is used to print, ink droplets ejected from the printing head of an inkjet printing apparatus are attached at deviated positions to deteriorate the printing quality. Further, there is a case where the printing element substrate 702 may be deformed and broken during the production.

SUMMARY OF THE INVENTION

Therefore, an object of the present invention is to provide an inkjet printing head which is not deteriorated in printing quality or broken in production processes.

A first aspect of the present invention can provide an inkjet printing head in which an ejection port-equipped printing element substrate is supported by a supporting member and a part adjacent to the printing element substrate is sealed by a sealant, wherein a rib is installed at a position opposing the side face of the printing element substrate in the supporting member and the rib can be displaced upon receiving stress from the sealant.

A second aspect of the present invention can provide a liquid ejecting printing head that comprises: a printing element substrate equipped with an ejection port for ejecting a liquid; a supporting member equipped with a face to which the printing element substrate is bonded, thereby supporting the printing element substrate on the face; a sealant for sealing one side face of the printing element substrate and the other side face which is a back face of the one side face concerned; and a plate-like member which is formed along the one side face and the other side face and also formed at a position opposing the one side face and the other side face; wherein the sealant is placed at a region between the one side face and the plate-like member as well as at a region between the other side face and the plate-like member.

According to the present invention, the supporting member of the inkjet printing head is provided with a rib at a position opposing the side end face of the printing element substrate, and the rib is displaced upon receiving stress from a sealant. Thereby, it is possible to provide the inkjet printing head which is not deteriorated in printing quality or broken in production processes.

Further features of the present invention will become apparent from the following description of exemplary embodiments (with reference to the attached drawings).

DESCRIPTION OF THE EMBODIMENTS

First Embodiment

Figure 1:
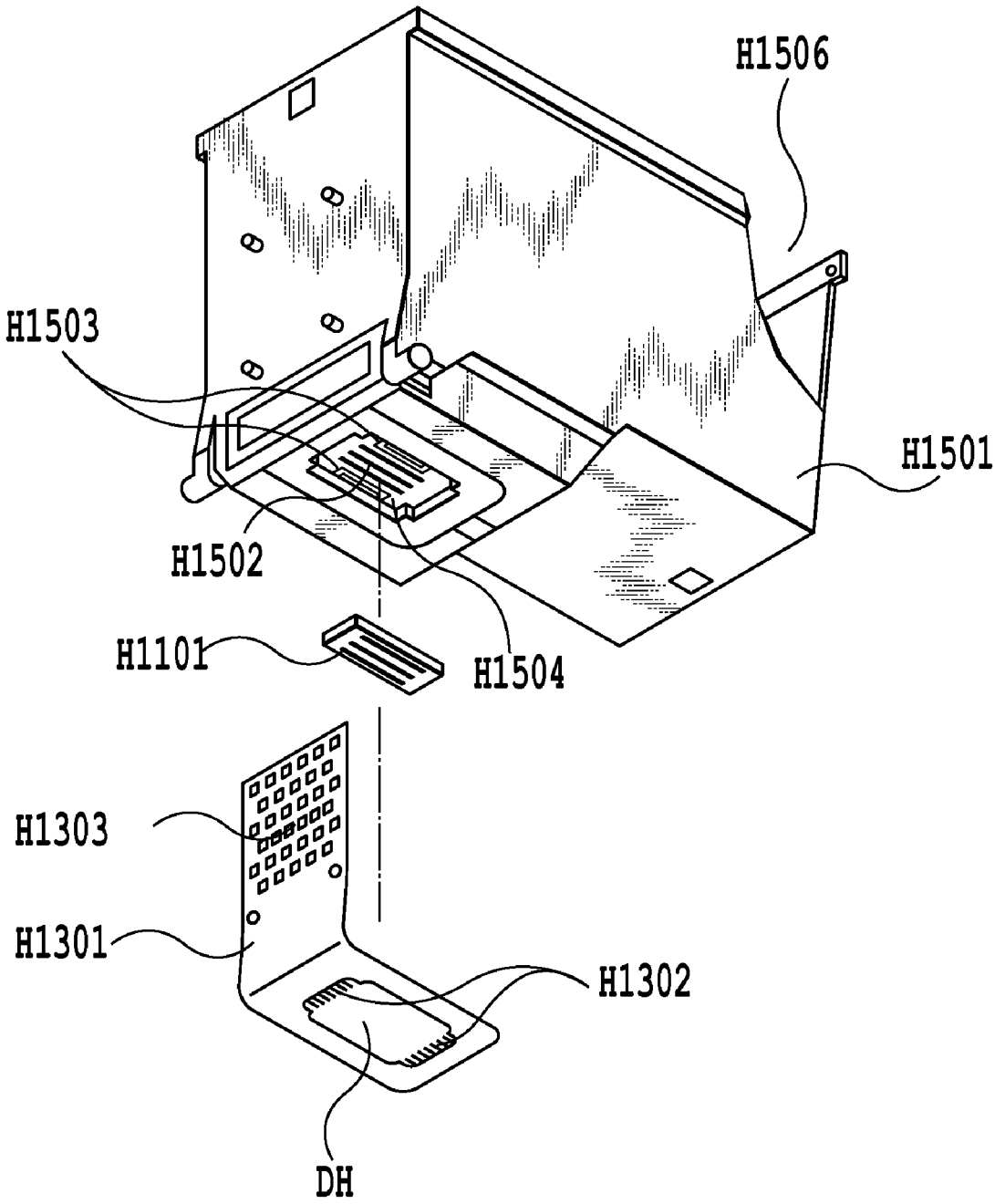
FIG. 1 is a schematic perspective view of an inkjet printing cartridge of a first embodiment which is disassembled by each component.

Hereinafter, description will be given for a first embodiment of the present invention by referring to the drawings.

FIG. 1 is a schematic perspective view of the inkjet printing cartridge of the present embodiment (hereinafter, simply referred to as a printing cartridge as well) which is disassembled by each component. An electric wiring substrate H1301 is provided with a device hole DH for assembling a printing element substrate H1101, an electrode terminal H1302 for corresponding to the printing element substrate H1101 and an external signal input terminal H1303 for receiving a control signal from the main body of the printing apparatus. The external signal input terminal H1303 and the electrode terminal H1302 are connected via a copper foil wiring. A supporting member H1501 is formed by resin molding and a resin material used in the present embodiment is a resin material in which a glass filler is contained at 35% for improvement in stiffness. This supporting member H1501 is provided with an ink supply channel H1502 from an ink reservoir unit H1506 and also provided at both sides of the ink supply channel H1502 with two ribs H1503 made with a plate-like member so as to be in parallel with the ink supply channel H1502 with respect to a face H1504 bonded to a printing element substrate. In the present embodiment, the rib is 0.5 mm in thickness. As will be described later, the rib is preferably 0.5 mm or lower in thickness so that the rib can be easily deformed by the stress generated on the sealant.

Figure 2A:
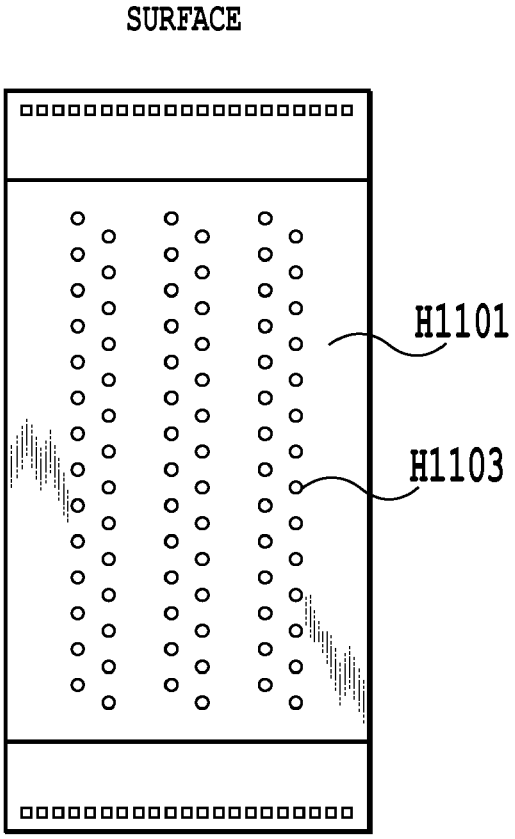
FIG. 2A is a view showing the surface of a printing element substrate.
Figure 2B:
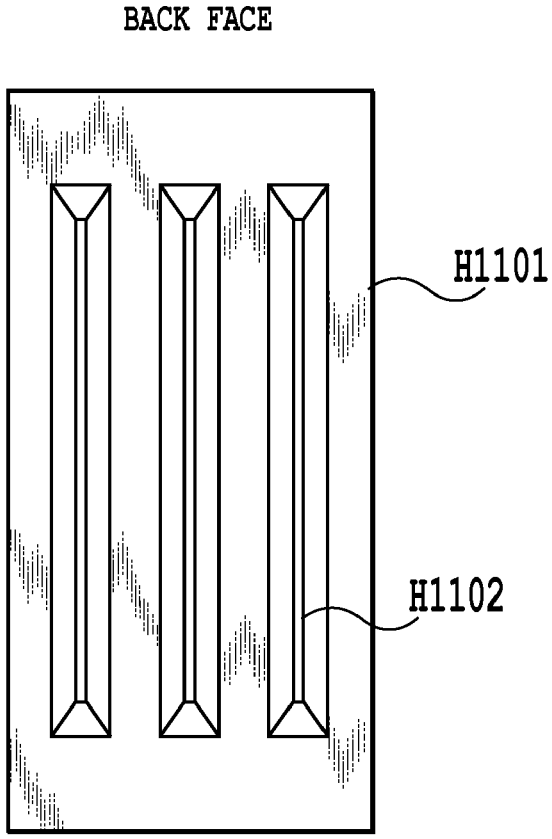
FIG. 2B is a view showing the back face of the printing element substrate.

FIG. 2A and FIG. 2B show the printing element substrate H1101; more particularly, FIG. 2A and FIG. 2B show respectively the surface and the back face thereof. A plurality of energy generating elements (hereinafter, referred to as heaters as well) (not illustrated) for ejecting inks and an electric wiring such as Al (not illustrated) for supplying electricity to each of the energy generating elements are formed by a film forming technology on one side of a 0.62 mm-thick Si substrate in the printing element substrate H1101. Further, a plurality of ink channels and a plurality of ink ejection ports H1103 installed so as to correspond to each of the heaters are formed by photolithography on the printing element substrate H1101. Still further, a plurality of ink supply ports H1102 for supplying inks to the ink channels are formed on the printing element substrate H1101 so as to open on the back face.

Figure 3:
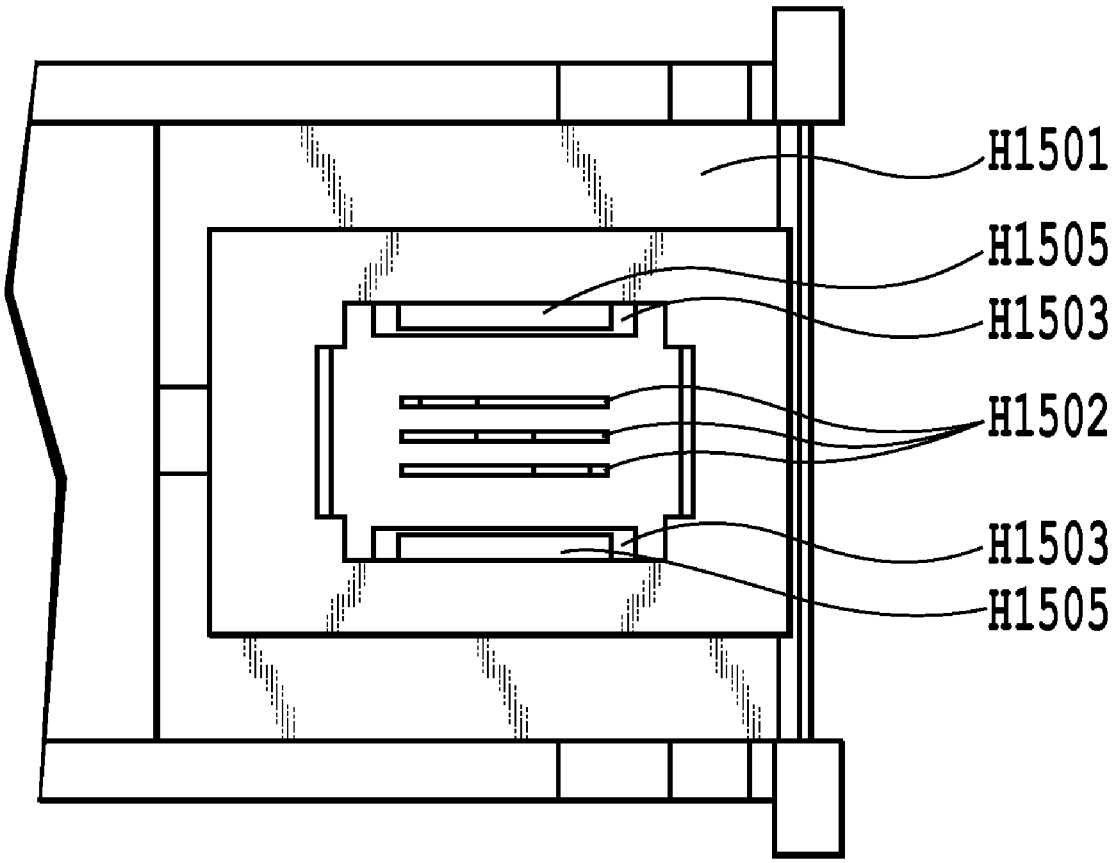
FIG. 3 is a plan view showing the bottom face of a supporting member of the first embodiment.

FIG. 3 is a plan view showing the bottom face of the supporting member H1501 of the present embodiment. The present embodiment is characterized by the ribs H1503 provided on both sides of the ink supply channel H1502. These ribs H1503 may be formed integrally with the supporting member H1501 or may be formed in separation and bonded with an adhesive agent or the like.

Figure 4:
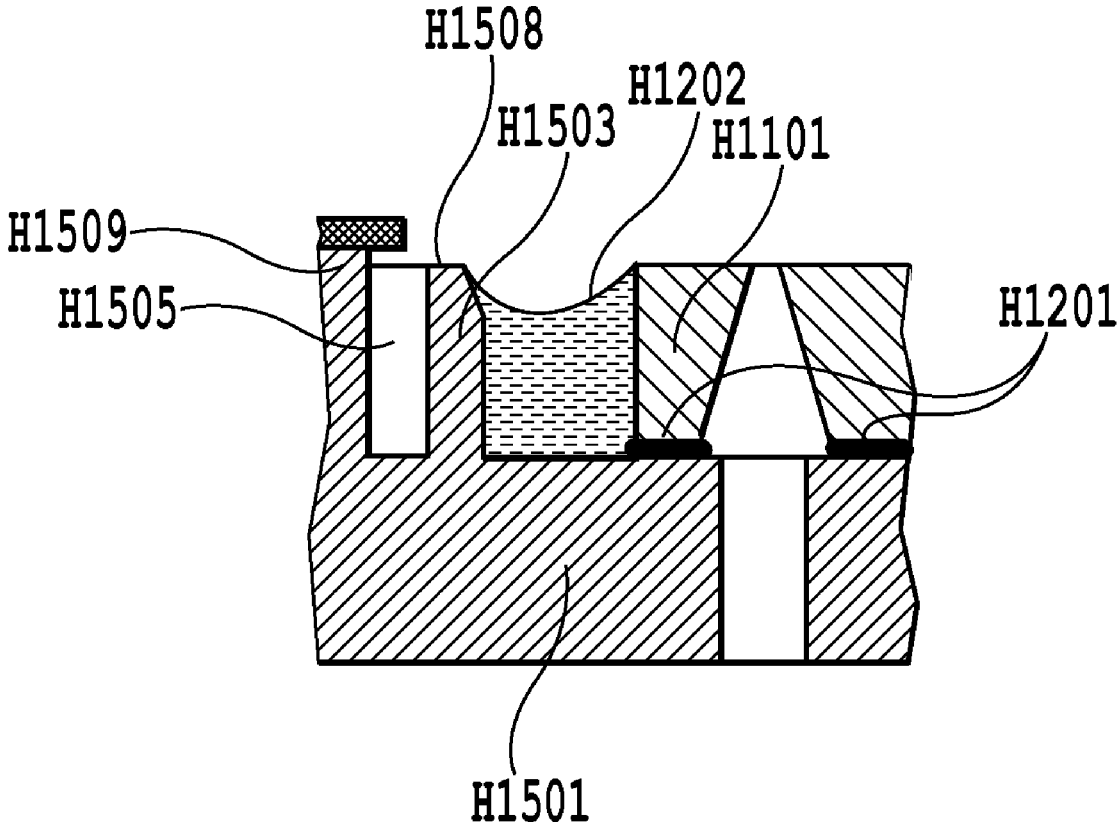
FIG. 4 is a cross-sectional view showing a part of a rib formed on the supporting member bonded to the printing element substrate.

FIG. 4 is a cross-sectional view showing a part of the rib H1503 formed on the supporting member H1501 bonded to the printing element substrate H1101. As shown in the figure, the rib H1503 of the present embodiment is installed between the printing element substrate H1101 and a wall part H1509 of the supporting member H1501. Then, a sealant H1202 is provided so as to seal between the printing element substrate H1101 and the rib H1503. Since the sealant H1202 is used to seal only a part which is adjacent to the printing element substrate H1101, the sealant H1202 is not provided at a region H1505 between the rib H1503 and the wall part H1509. More specifically, the region H1505 is given as a space. Further, a part of the rib on the printing element substrate side is made tapered at the leading end thereof so that no sealant will flow into the space region. Still further, the printing element substrate H1101 is bonded and fixed to the supporting member H1501 by using a thermosetting adhesive agent H1201 and constituted so as to cover the periphery of the printing element substrate H1101 with the sealant H1202. It is desirable that the adhesive agent H1201 and the sealant H1202 are lower in curing temperature, cured in a short time and resistant to ink. The adhesive agent H1201 and the sealant H1202 used in the present embodiment are of a thermosetting type based mainly on an epoxy resin. The thermosetting-type adhesive agent H1201 and the sealant H1202 are those which are cured at 100° C. for one hour to realize desirable properties such as ink resistance and adhesiveness. However, the adhesive agent H1201 and the sealant H1202 shall not be limited to those described above and may include others as long as they can meet conditions required for individual inkjet printing heads.

Figure 5A:
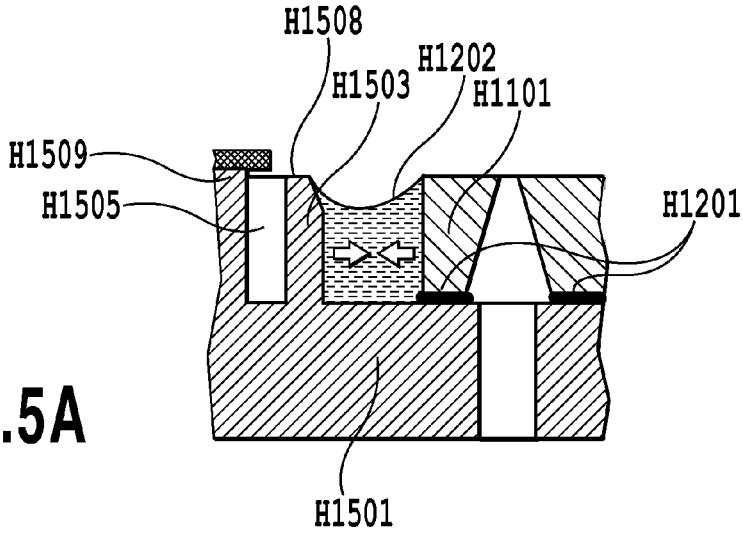
FIG. 5A is a view showing how stress is generated where a sealant undergoes shrinkage on curing in the supporting member of the first embodiment at which the rib is installed.
Figure 5B:
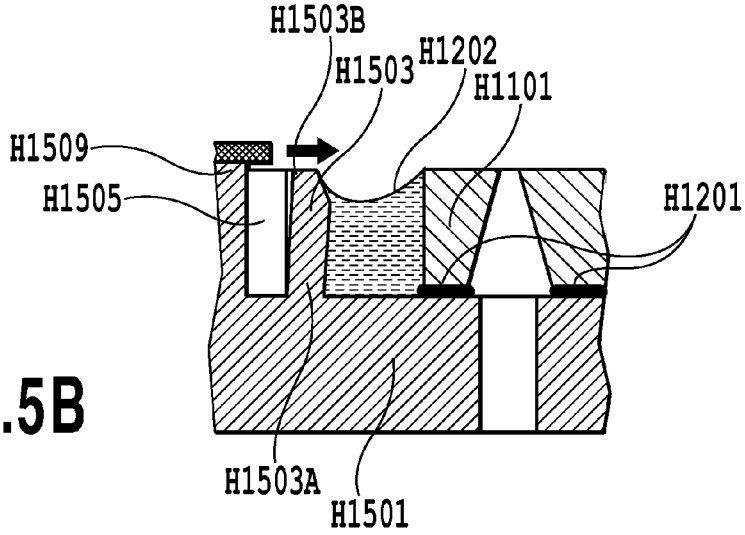
FIG. 5B is a view showing how stress is generated where the sealant undergoes shrinkage on curing in the supporting member of the first embodiment at which the rib is installed.
Figure 5C:
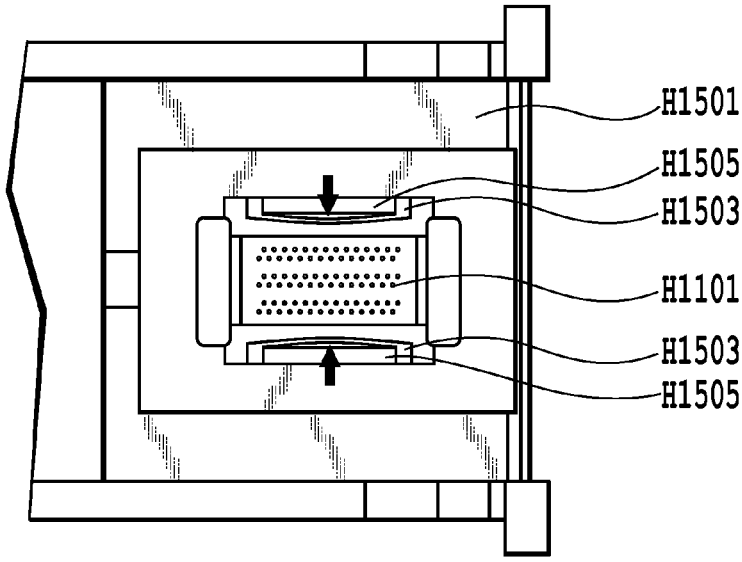
FIG. 5C is a view showing how stress is generated where the sealant undergoes shrinkage on curing in the supporting member of the first embodiment at which the rib is installed.

FIG. 5A through FIG. 5C are views showing how stress is generated where the sealant H1202 undergoes shrinkage on curing in the supporting member H1501 of the present embodiment at which the rib H1503 is installed. When the sealant H1202 is cured, stress is generated in a direction indicated by the arrow in FIG. 5A according to the shrinkage on curing and change in temperature. Then, the rib H1503 is constituted so that upon generation of stress on the sealant H1202, it is inclined due to the stress as shown in FIG. 5B. Since the rib H1503 can be deformed as described above to absorb the stress generated on the sealant H1202, influence is greatly reduced on the printing element substrate H1101 by the stress generated on the sealant. The printing element substrate H1101 has such a positional relationship that a side face formed along the longitudinal direction (hereinafter, referred to as a long side face as well) is relatively close to ink supply ports, and where an external force is applied to the long side face, the side face is easily deformed or broken.

Therefore, as shown in FIG. 5C, the ribs H1503 are continuously installed at a position opposing the long side face of the printing element substrate H1101 and stress applied to both sides of the printing element substrate H1101 is alleviated substantially evenly. As a result, it is possible to suppress to a negligible extent influences on printing qualities resulting from the deformation of the printing element substrate H1101 or others.

Figure 6:
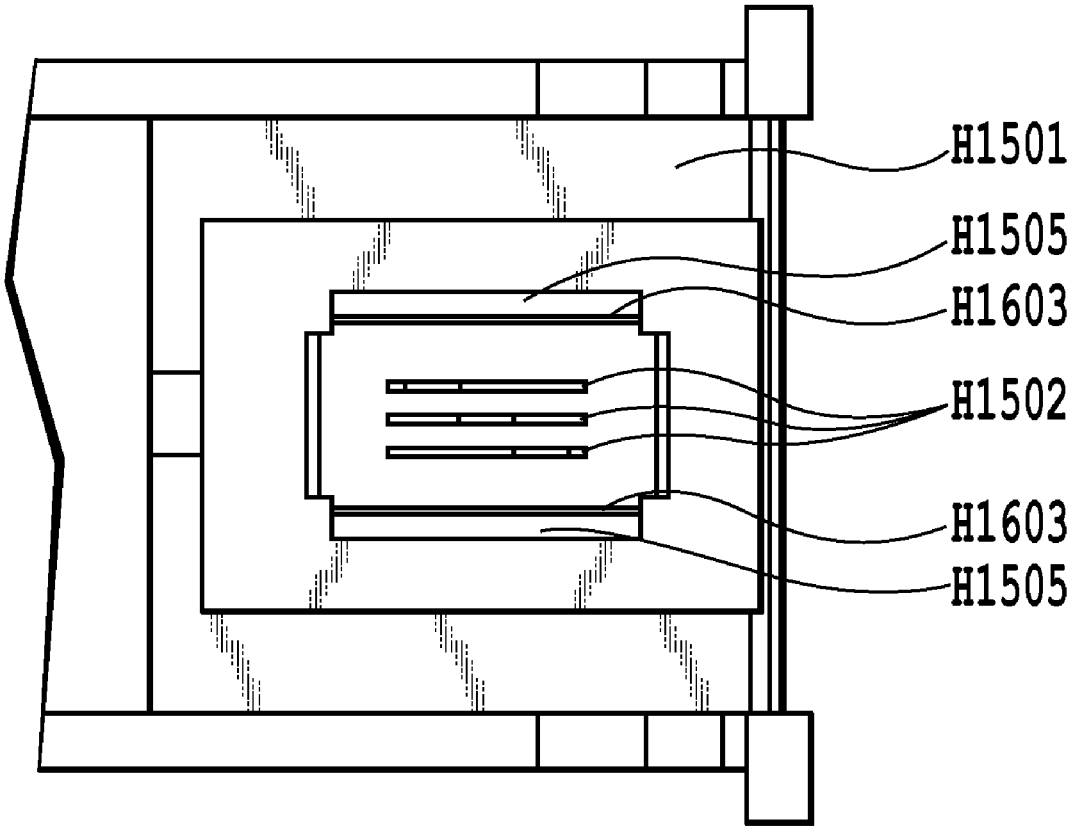
FIG. 6 is a plan view showing a modified example of the ribs of the first embodiment.

FIG. 6 is a plan view showing a modified example of the ribs of the present embodiment. As shown in FIG. 6, the ribs H1603 may be installed so as to oppose each other all over across the width of the long side face of the printing element substrate. As described above, since the ribs H1603 are deformed so as to absorb stress generated on the sealant, it is preferable that the ribs are thinner and longer. More specifically, it is preferable that the ribs H1603 are formed so as to be equal to or, more preferably, longer than ink supply ports H1502 formed on the printing element substrate. Further, in order to attain an easy deformation of the ribs H1603, it is preferable that the ribs are formed continuously. However, a plurality of ribs may be formed discontinuously along the long side face of the printing element substrate. In this instance, it is preferable that an interval between the ribs is made large enough so that no sealant will flow out between the rib and the wall part H1509 due to the meniscus force thereof.

In the present embodiment, the ribs H1503 are installed only at positions opposing the long side face of the printing element substrate H1101, to which the present invention shall not be limited. The ribs H1503 may be installed at positions opposing the long side face and also at positions opposing a short side face of the printing element substrate. Similarly, in the present invention, at least one side face of the printing element substrate and the other side face, which is a back face thereof, may be sealed. However, the remaining other side faces may also be sealed.

As described above, the ribs which can be displaced upon influence of stress resulting from a sealant are installed at positions opposing the long side face of the printing element substrate, thereby the sealant is used to seal between the ribs and the printing element substrate. Thus, it is possible to reduce the stress applied to the printing element substrate from the sealant and also prevent the printing element substrate from breakage or deterioration in printing quality in production processes.

Second Embodiment

Hereinafter, description will be given for a second embodiment of the present invention by referring to the drawings. Since the constitution of the present embodiment is basically the same as that of the first embodiment, description will be given only for a characteristic constitution below.

Figure 7A:
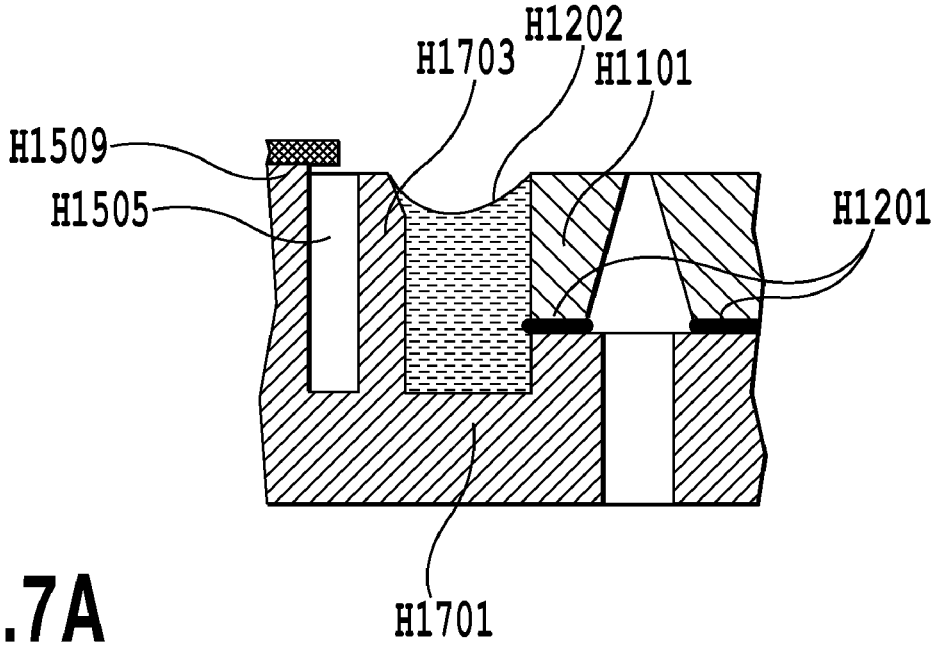
FIG. 7A is a cross-sectional view which enlarges a part of the supporting member at which the rib of a second embodiment is installed.
Figure 7B:
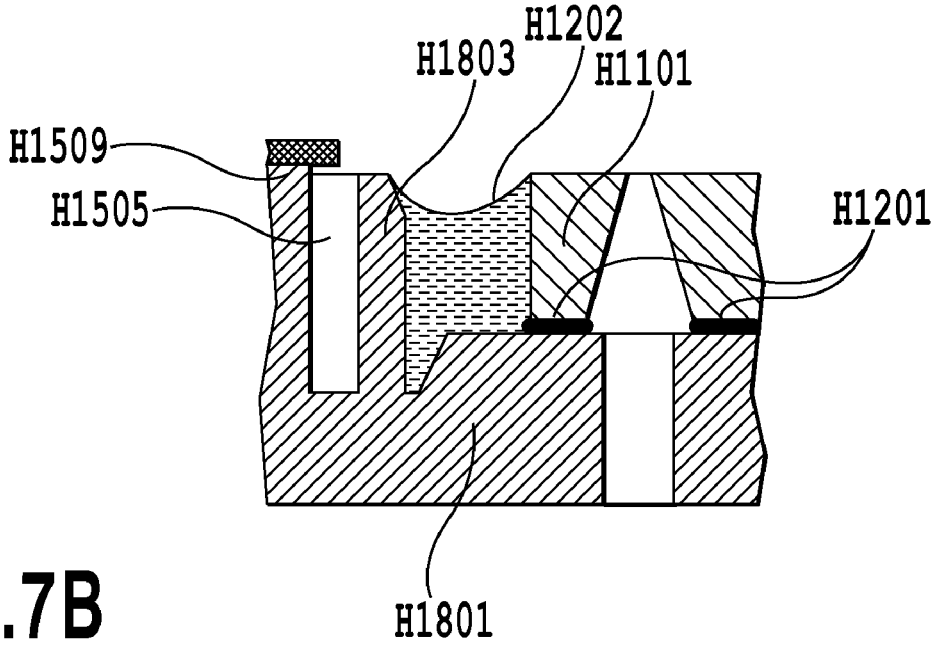
FIG. 7B is a cross-sectional view which enlarges a part of the supporting member at which the rib of a modified example of the second embodiment is installed.
Figure 8:
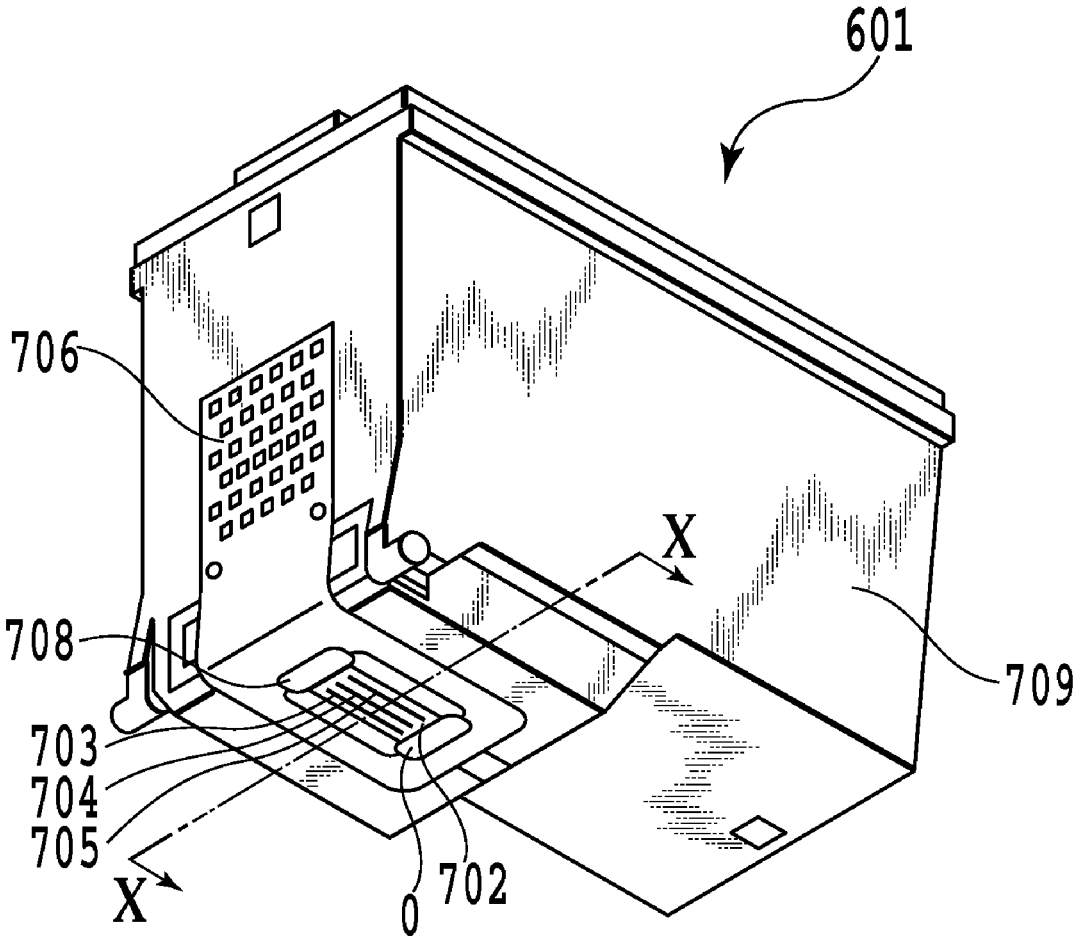
FIG. 8 is a view showing a conventional inkjet printing cartridge.
Figure 9:
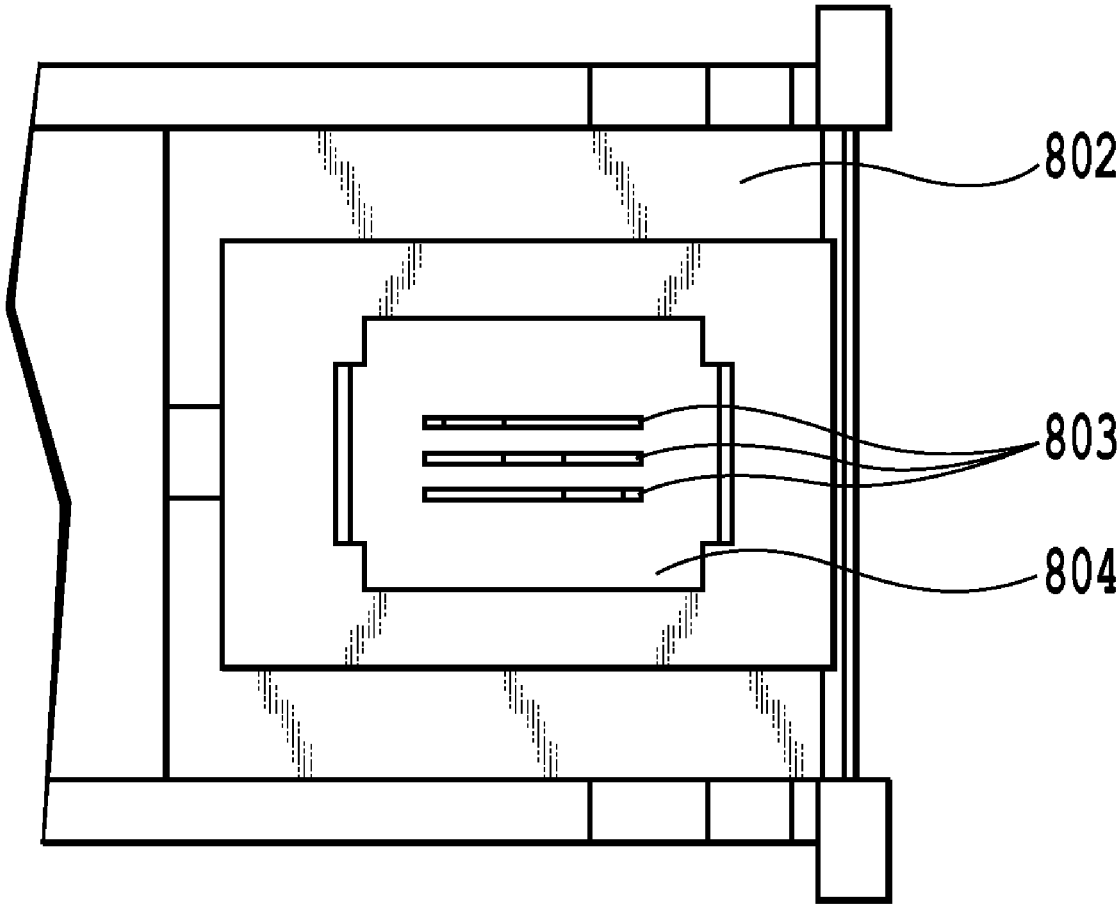
FIG. 9 is a view showing the supporting substrate for supporting a conventional printing element substrate and the supporting plate for fixing and supporting an electric wiring substrate.
Figure 10:
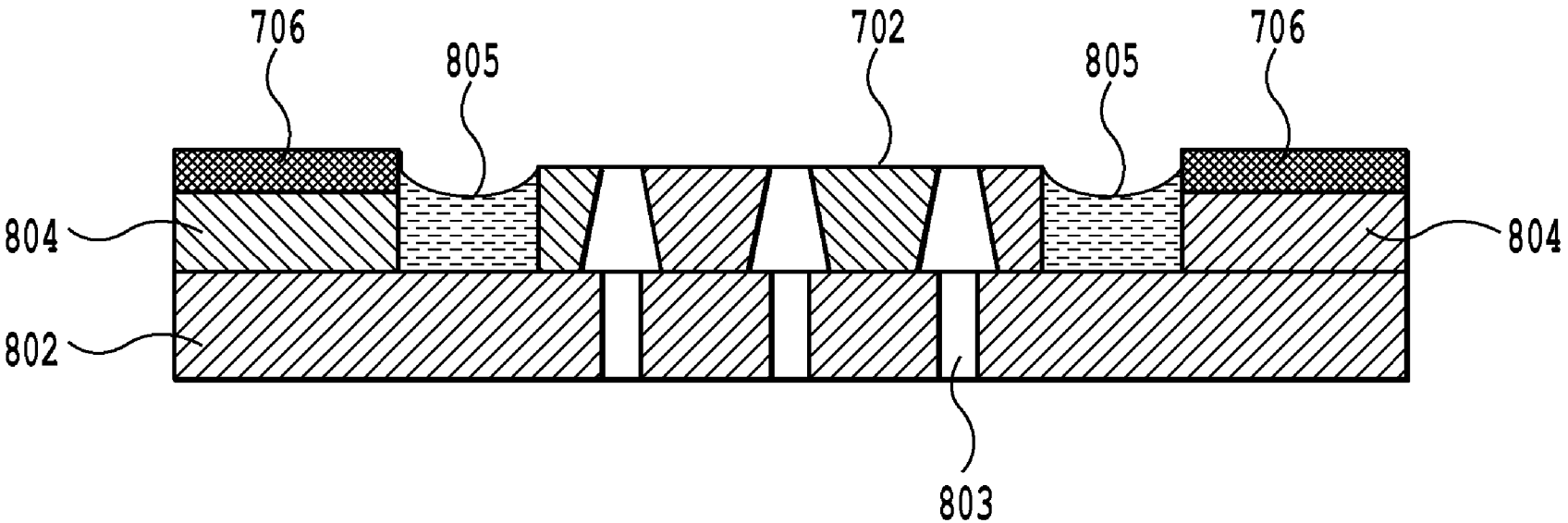
FIG. 10 is a cross-sectional view taken along the line X to X in FIG. 8.
Figure 11:
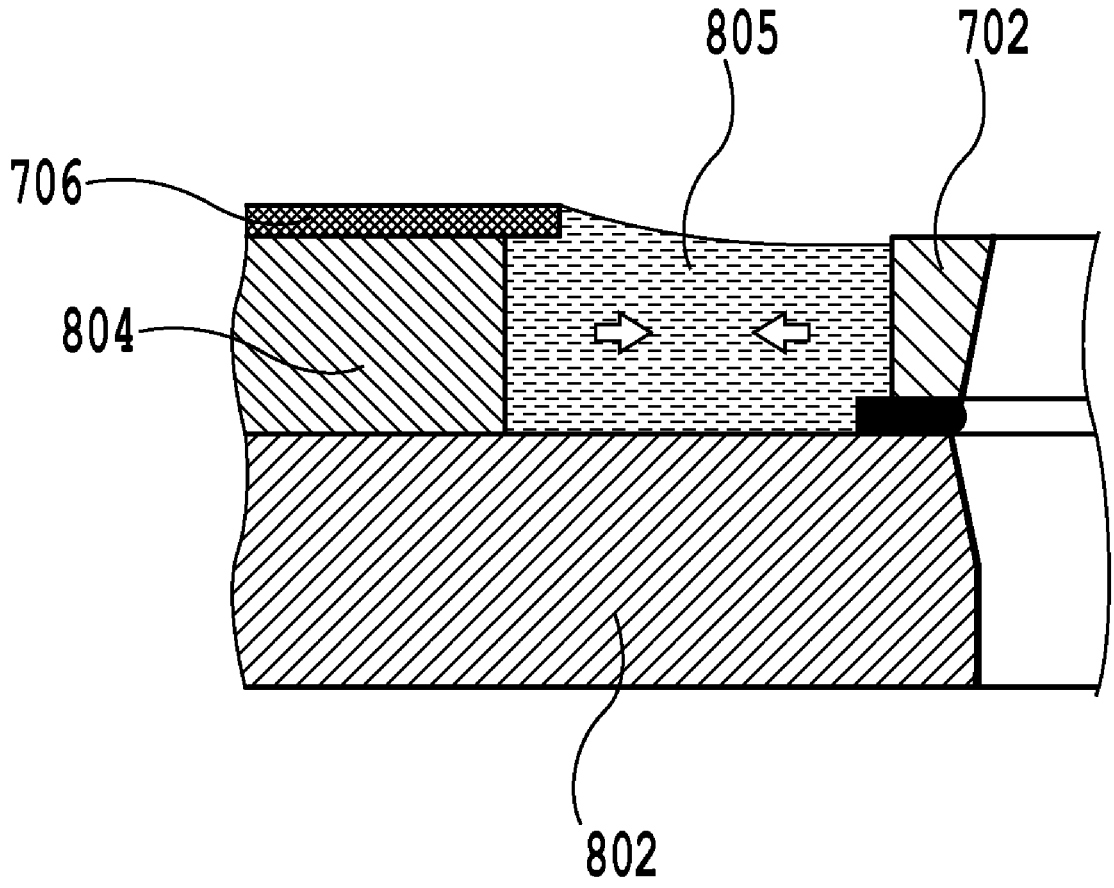
FIG. 11 is a view showing how stress inside the sealant acts on the printing element substrate.

FIG. 7A is a cross-sectional view which enlarges a part of the supporting member H1701 at which the rib H1703 of the present embodiment is installed. FIG. 7B is across-sectional view which enlarges a part of the supporting member H1801 at which the rib H1803 of a modified example of the present embodiment is installed.

In the first embodiment, the printing element substrate H1101 is approximately equal in height to the rib H1503. However, in the present embodiment, a groove of the supporting member H1701 or that of the supporting member H1801 at a part where the rib is installed is made deeper than in the case of the first embodiment.

The rib which receives stress from the sealant after curing is displaced to a greater extent at a rib top part H1503B (refer to FIG. 5B) than at a rib starting part H1503A (refer to FIG. 5B). More specifically, in the first embodiment, the sealed end face of the printing element substrate H1101 is not reduced in stress evenly from the lower part closer to a part bonded to the supporting member H1501 up to an upper part thereof but reduced in stress more greatly from the lower part to the upper part.

Therefore, as shown in the present embodiment, the rib H1703 is installed from a position lower (deeper) than a face on which the printing element substrate H1101 is bonded to the supporting member H1701, thereby reducing more greatly the stress applied to the lower part of the printing element substrate H1101 from the sealant H1202. The present embodiment is preferable in constitution to the first embodiment in that it is able to alleviate influence of stress on a part at which the printing element substrate H1101 is bonded to the supporting member H1701.

Further, as shown in FIG. 7B, the groove is made deeper at a part close to a supporting point of the rib H1803, while the other parts may be made equal in height to the face bonded to the printing element substrate H1101. Since the sealant H1202 is used in a smaller absolute quantity as compared with FIG. 7A, it is preferable that the stress generated on curing of the sealant can be reduced and the stress applied to the printing element substrate H1101 due to the rib H1803 can be also reduced. Further, the sealant H1202 can be used in a reduced quantity as compared with the constitution shown in FIG. 7A, thereby attaining a reduction in production cost.

As described so far, the rib which is installed on the supporting member is provided at a position lower than a face on which the printing element substrate is bonded to the supporting member, thus making it possible to efficiently reduce the stress applied to the printing element substrate from a sealant. It is thereby possible to reduce the stress applied to the printing element substrate from the sealant and also prevent the printing element substrate from breakage or deterioration in printing quality in production processes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-158206, filed Jun. 17, 2008, and 2009-130835, filed May 29, 2009 which are hereby incorporated by reference herein in their entirety.

What is claimed is:

1. A liquid ejecting printing head comprising:

a printing element substrate having an ejection port for ejecting a liquid;

a supporting member having a face to which the printing element substrate is bonded, thereby supporting the printing element substrate on the face;

a sealant for sealing one side face of the printing element substrate and another side face which is an opposite face of the one side face; and ribs which are formed along and opposing the one side face and the other side face, wherein the sealant is disposed at a region between the one side face and one of the ribs, as well as at a region between the other side face and another of the ribs, and the sealant is not provided at a back side of the ribs, the back side of the ribs not facing the printing element substrate.

2. The printing head as set forth in claim 1, wherein two of the ribs are positioned behind the printing element substrate.

3. The printing head as set forth in claim 1, wherein at least one of the ribs is formed integrally with the supporting member.

4. The printing head as set forth in claim 1, wherein at least one of the ribs is formed separately from the supporting member.

5. The printing head as set forth in claim 1, wherein at least one of the ribs is installed along the entire width of the printing element substrate.

6. The printing head as set forth in claim 1, wherein the sealant is used to seal between the ribs and the printing element substrate.

7. The printing head as set forth in claim 1, wherein a height from a base of at least one of the ribs to a top part thereof is greater than a thickness of the printing element substrate.

8. The printing head as set forth in claim 7, wherein the base of at least one of the ribs is positioned at a position lower than the face of the supporting member bonded to the printing element substrate.

9. The printing head as set forth in claim 7, wherein a part of the face of the supporting member to which the printing element substrate is bonded receives the sealant between the ribs and the printing element substrate.

10. A liquid ejecting printing head comprising:

a printing element substrate having an ejection port for ejecting a liquid;

a supporting member having a face to which the printing element substrate is bonded, thereby supporting the printing element substrate on the face;

a sealant for sealing one side face of the printing element substrate and another side face which is an opposite face of the one side face; and a plate-like members which are formed along and opposing the one side face and the other side face, wherein the sealant is disposed at a region between the one side face and one of the plate-like members as well as at a region between the other side face and another of the plate-like members, and the sealant is not provided at a back side of the plate-like members, the back side of the plate-like members not facing the printing element substrate.

11. The printing head according to claim 10, wherein a tip of at least one of the plate-like members can be displaced in a direction of the one side face of the printing element substrate.

12. The printing head according to claim 10, wherein an intersection point of at least one of the plate-like members with the supporting member is positioned at a position lower than the face of the supporting member.

* * * * *